US006983709B2

(12) United States Patent
Hickok

(10) Patent No.: US 6,983,709 B2
(45) Date of Patent: Jan. 10, 2006

(54) CHAMBERED HULL BOAT DESIGN METHOD AND APPARATUS

(75) Inventor: William L. Hickok, Bellingham, WA (US)

(73) Assignee: ACB's Aluminum Chambered Boats, Bellingham, WA (US)

( * ) Notice: Subject to any disclaimer, the term of this patent is extended or adjusted under 35 U.S.C. 154(b) by 0 days.

(21) Appl. No.: 10/723,402

(22) Filed: Nov. 26, 2003

(65) Prior Publication Data

US 2005/0005838 A1 Jan. 13, 2005

Related U.S. Application Data

(63) Continuation of application No. 10/350,843, filed on Jan. 24, 2003, now abandoned, which is a continuation of application No. 09/642,113, filed on Aug. 18, 2000, now Pat. No. 6,520,107.

(60) Provisional application No. 60/149,957, filed on Aug. 19, 1999.

(51) Int. Cl.
*B63B 43/14* (2006.01)

(52) U.S. Cl. ..... 114/123; 114/356; 441/40

(58) Field of Classification Search ..... 114/355, 114/356, 123; 441/35, 40
See application file for complete search history.

(56) References Cited

U.S. PATENT DOCUMENTS

| | | | | |
|---|---|---|---|---|
| 3,261,038 | A * | 7/1966 | Klepper | 114/345 |
| 4,919,067 | A * | 4/1990 | Wenstob et al. | 114/345 |
| 6,520,107 | B1 * | 2/2003 | Hickok | 114/355 |

* cited by examiner

*Primary Examiner*—Jesus D. Sotelo
(74) *Attorney, Agent, or Firm*—Michael F. Hughes; Hughes Law Firm, PLLC

(57) ABSTRACT

A multichambered boat that is constructed upside-down on stationary platforms where flotation chambers are located in the perimeter portion of the multichambered boat. The perimeter chambers have a laterally downward sloping exterior surface that directs fluid downwardly and provides lift to the multichambered boat which creates a smoother ride. A fuel input line that passes through the flotation chamber to the fuel storage tank to provide convenient access for refueling the multichambered boat.

4 Claims, 6 Drawing Sheets

48
22
50
30
52
42
32a
32b
32e
44
46
32d
32c
30b
34
30a

CHAMBERED HULL BOAT DESIGN METHOD AND APPARATUS

RELATED APPLICATIONS

This application is a Continuation Patent Application of U.S. patent application Ser. No. 10/350,843 filed Jan. 24, 2003, now abandoned which is a Continuation Patent Application of U.S. patent application Ser. No. 09/642,113 filed Aug. 18, 2000 now U.S. Pat. No. 6,520,107; which in turn is based on 60/149,957 filed Aug. 19, 1999.

FIELD OF THE INVENTION

The invention relates to chambered water vessels and the location and design of chamber walls, and other design features. Further, the invention relates to a method of manufacture to produce the water vessels.

BACKGROUND

It is desirable to have watercrafts to remain afloat even when the open hull becomes filled of water. To make this possible discrete floatation chambers have been employed in watercraft for many years. Thus, in the event that the seal of one chamber is compromised and the buoyant effect of that chamber is lost, the other chambers will still have a buoyant effect so that the watercraft will remain afloat.

Due to the safety problems of punctured chambers the U.S. Coast Guard has implemented rigorous standards with which the boats under their jurisdiction must comply. One such regulation is the mandatory use of foam in the chambers to reduce the amount of water the chamber would take on in the event the chamber wall is punctured. There are many problems with foam injected chambers. First, it is very costly to inject foam into the chamber; the foam must be distributed evenly and the injection equipment is expensive to purchase and maintain. Secondly, If the foam filled chamber is punctured, repair of the chamber is difficult to impossible. It is somewhat difficult to remove the water that is soaked into the foam. Further, the aluminum wall that defines the chamber must be welded to recreate a sealed chamber and the heat from the welding process will melt the foam, creating noxious gas and leaving a portion of combusted foam no longer of use for floatation.

Another aspect of the design and manufacture of floatation boats is the construction of chambers has traditionally been accomplished by rolling sheets of aluminum to form a curved wall to define the chambers. There are numerous problems with the rolling process that results in variations in the shape and dimensions in the chamber walls. This lack of consistency makes the use of efficient manufacturing techniques difficult or in some instances impossible.

Another method of creating chamber walls is to extrude the aluminum through a mold to a preferred shape. This process is very expensive and can weaken the metal.

Yet another aspect related to the larger boats which generally have an internal combustion engine to power the prop, the fuel tank must reside in a safe place while still having a convenient access to the tank. The inlet port to refuel the tank has traditionally been in the back of the water vessels near the engine. Often times when a boat is in the water, the rear of a boat is lower than the front, because there is generally more load to the rear of the center of buoyancy of the water vessel. This position of the boat causes the gas to shift to the rear of the tank, which increases the hydrostatic pressure for a refueling inlet port located in the rear of the boat. This increase in pressure makes refueling more difficult

SUMMARY OF THE INVENTION

The invention is a multichambered boat having a central lower portion and a lateral portion where the central portion slopes upwardly from the laterally inwardly portion to the laterally outworked portion where it engages a perimeter contact surface that slopes laterally downwardly. The perimeter contact surface is part of a flotation chamber. The flotation chambers are located in the perimeter portion of the boat and provide buoyant lift. A fuel input line having an intake nozzle located in the upper portion of the flotation chamber and a central line extending through the chamber to an outtake nozzle located in the laterally inwardly portion of the chamber. The outtake nozzle is connected to a flexible close that is in communication to the fuel storage tank.

The multichambered boat hull is manufactured by utilizing stationery platforms having placement holders that are adapted to hold multi-creased wall sections that eventually form floatation chambers. Baffles are placed in between two adjacent multi-creased wall sections and are welded thereto to form discrete chambers.

One aspect of the invention is a strategic and precise placement of the chambers to minimize cost of construction and maintain a high level of safety in the event several chambers are punctured. The invention removes the need for costly foam injection chambers by placing the chambers at locations to reduce the risks in circumstances where multiple chambers are punctured.

Another aspect of the present invention is that each of the chambers are defined by a multi-creased wall that comprises a plurality of longitudinal creases or bends. The construction of the wall is accomplished by taking a flat piece of metal, preferably aluminum, and bend it about a longitudinal straight edge. This process is continued until the wall loops around to create a continuous tube like configuration, where the chamber has in cross sectional configuration the shape of an irregular polygon. This multi-creased wall is configured in a way so that it has an increased moment of inertia about the transverse axis, thus creating a stronger vessel. A majority of the bending moments on a water vessel are about the transverse axis, therefor increasing the moment of inertia about the transverse centroidal axis reduces the stresses experienced on the multi-creased walls and the water vessel as a whole.

After the multi-creased sections are formed they are assembled together in a rigid platform assembly to create very consistent dimensions of the final boats produced.

A further advantage of the preferred embodiment is a oblique surface in the lower portion of the multi-creased wall which has particular fluid flow advantageous by directing up-skirting water along the v-shaped hull in a downward direction, thus creating lift and a smoother ride for the passengers. This is beneficial in rough waters where the boat is impacting waves. The oblique surface can also assist in cornering as well. This oblique surface has the additional advantages of reducing the spray that is created when the water flows around the V-shaped wall in the lower hull.

The result is a light, safe high performance water vessel that is less expensive to manufacture.

BACKGROUND ART

A search of the patent literature has a number of patents directed toward creating flotation chambers. U.S. Pat. No. 4,667,618 Cigognetti, shows a means to form a water tight space between keel and deck elements in an inflatable boat. The keel section 2, and the deck section 1, are joined at the edges to tubes 5, and 6. Tubes 5, and 6, may be either the floats, or float housings.

The following patents show various boat configurations in which there are water tight compartments along at least part of the sides, and which are joined to form a hull.

U.S. Pat. No. 5,699,749 Yamada, shows a personal watercraft in which the hull is provided with a sponson 73, seen best in FIGS. 1, 7, 8, and 9. The assembly appears to be bolted to the remaining parts of the hull.

U.S. Pat. No. 5,546,886 Franceschelli et al, shows a boat built upon hull "T", and deck "C". There are compartments 3, formed in tubular enclosures along each side.

U.S. Pat. No. 5,261,345 Fleming, shows a boat in which inflatable air bladders 2, may be joined to rigid bottom 4 shown in FIG. 2.

U.S. Pat. No. 5,184,566 Cochran, shows a girder type hull to which flotation element 80 is secured.

U.S. Pat. No. 5,078,072 Horiuchi et al, shows a boat formed with a pair of outer sponsons 13, which appear to form water tight portions and hull elements 12.

U.S. Pat. No. 4,781,136 Van Der Velden, shows a cockpit suspended between a pair of water tight sponsons.

U.S. Pat. No. 4,627,372 Douglas, shows a catamaran in which the hull section are formed of sections 11 that are provided on the ends with pointed or streamlined elements 12. The sections 11 are rectangular and mounted so that an edge is at the lowest point so that it forms a keel like configuration.

U.S. Pat. No. 4,348,972 Parsons, shows a three hulled boat in which there is a central hull 12, and a pair of side hulls 32 and 34 which are joined by a deck which is above the waterline.

U.S. Pat. No. 4,192,248 Moyer, shows a hull that is formed from two elements that are joined in the center.

U.S. Pat. No. 4,046,092 Tornqvist, shows a cargo ship hull in which the sides and the bottom of the top deck are joined where the upper wingward spaces 9' and 9", are provided that house pipelines, conveyors, or the like.

U.S. Pat. No. 3,470,839 Faul et al, shows a boat in which there are hull structures on each side and a central bottom portion that is partially in the water.

U.S. Pat. No. 3,140,686 Olivotti, provides a boat with side stabilizing elements "ST", that extend from the side above the level of the water.

U.S. Pat. No. 2,560,153 Blount, shows a boat that is formed of two parallel cylinders that are joined by bulkhead elements 20. Plates 24 and 25 are secured to the cylinders to form the bottom and the deck of the ship. The ends of the cylinders are shaped to form bow and stern configurations.

U.S. Pat. No. 1,303,690 Leparmentier, shows a barge that is formed of two cylindrical floats that are joined by plates a, b, and c. The space between "b", and "c", may be used for liquid cargo or ballast, and the section between "a", and "c", may be Used for storage or equipment.

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

Figure 1:
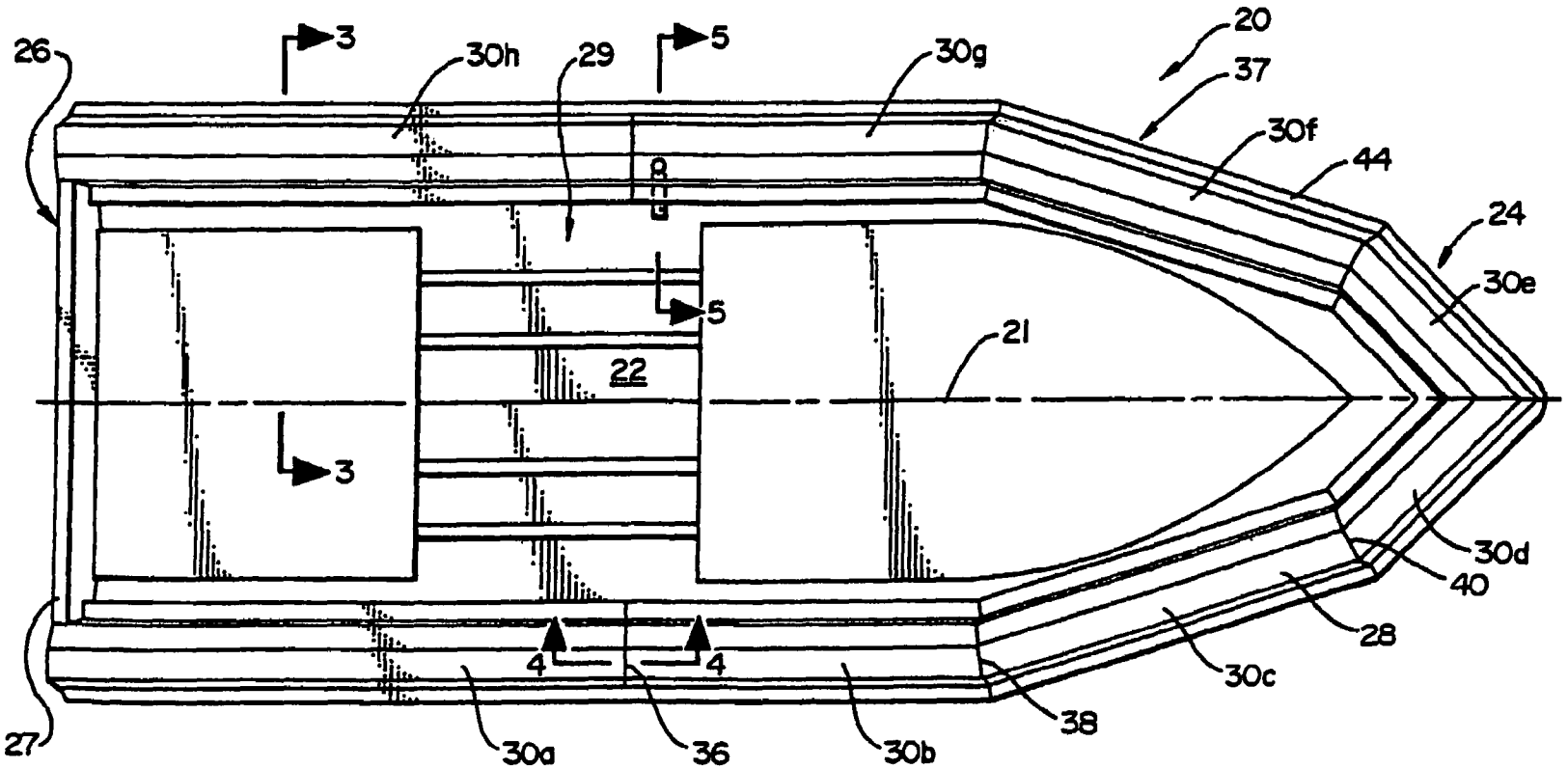
FIG. 1 is a plan view of a the preferred embodiment of a hull configuration.

As seen in FIG. 1, the chambered boat hull 20 comprises a V-shaped bottom wall 22, a bow 24, a stern 26, a rear plate 27, a perimeter hull portion 28 and a central hull portion 29. The chambered boat hull 20 has a longitudinal axis 21 that runs from the bow 24 to the stern 26 and is symmetrically positioned in the center portion of the chambered boat hull 20 as shown in FIG. 1. The chambered boat hull 20 further has a vertical axis running from the upper portion to the lower portion of the chambered hull and a transverse axis running from the center of the chambered hull and extending outwardly in a level plane and perpendicular to the longitudinal axis. The central hull portion is contracted so that a cab or other structure can be mounted thereon.

Figure 5:
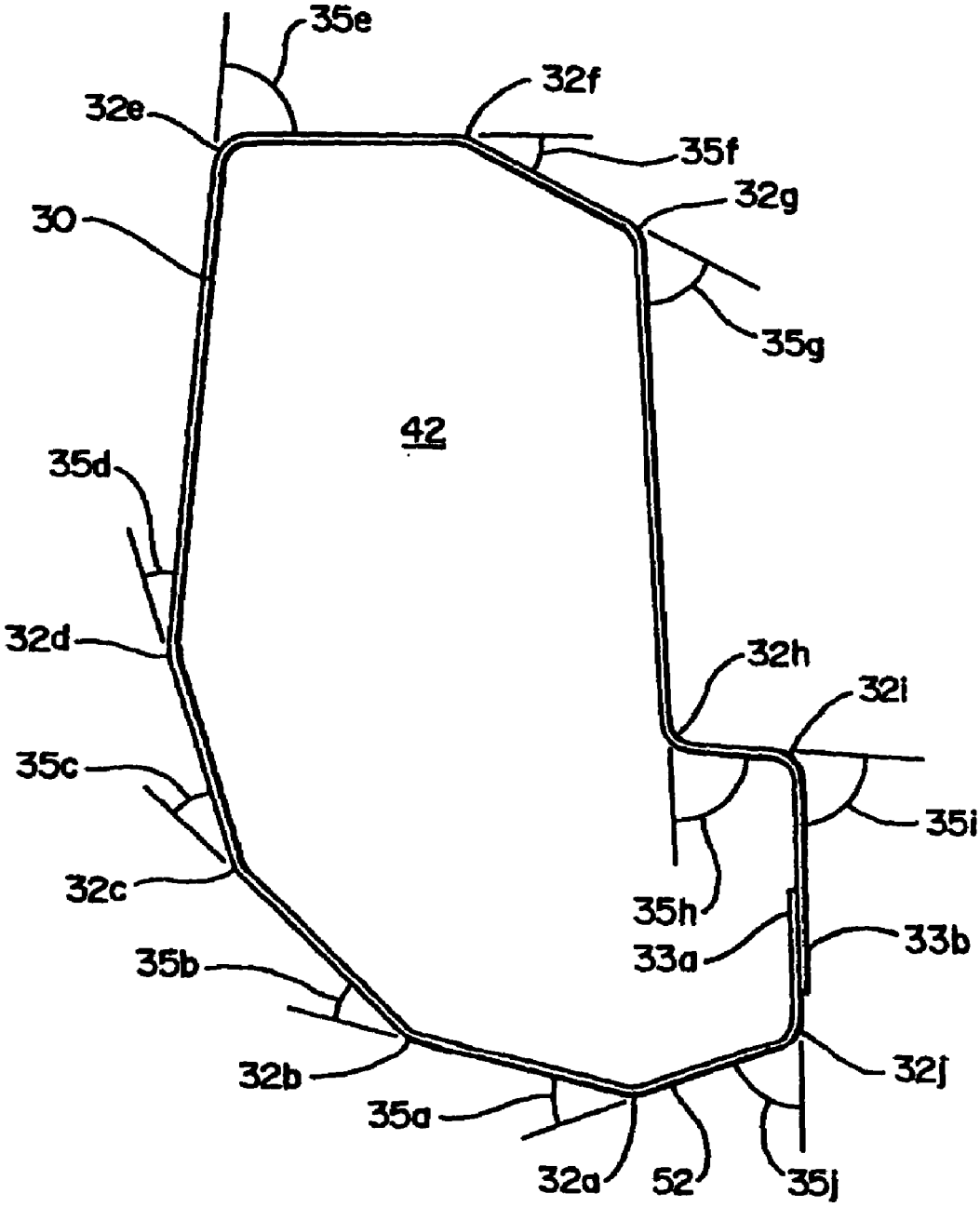
FIG. 5 is a cross sectional view of a multi-creased chamber wall taken at line 5—5 in FIG. 1.

The perimeter hull portion 28 comprises a plurality of multi-creased wall sections 30 that are best seen in FIG. 5. Each of these wall sections have a plurality of creases 32. The wall sections 30 are constructed by taking a flat piece of metal and making several sharp bends at designated locations 32. The end locations 33*a* and 33*b* of the multi-creased wall section 30 over lapped and are welded together to create a seal. The angles of the bends at creases 35 are as follows:

| | |
|---|---|
| 35a | 33° |
| 35b | 30° |
| 35c | 28° |
| 35d | 20° |
| 35e | 85° |
| 35f | 26° |
| 35g | 61° |
| 35h | −85° |
| 35i | 86° |
| 35j | 70° |

Each angle can vary to some degree, and further, more creases can be added without departing from the spirit of the invention.

The angle of surface 52 (35*j*) with respect to the vertical axis has a most desirable range between 80° and 87°, and a secondary desirable range between 75° and 90°. The angle of exterior surface 48 of the V-shaped bottom wall 22 has a most desirable range between 15° and 22°, and a secondary desirable range between 10° and 26°.

Figures 3, 4:
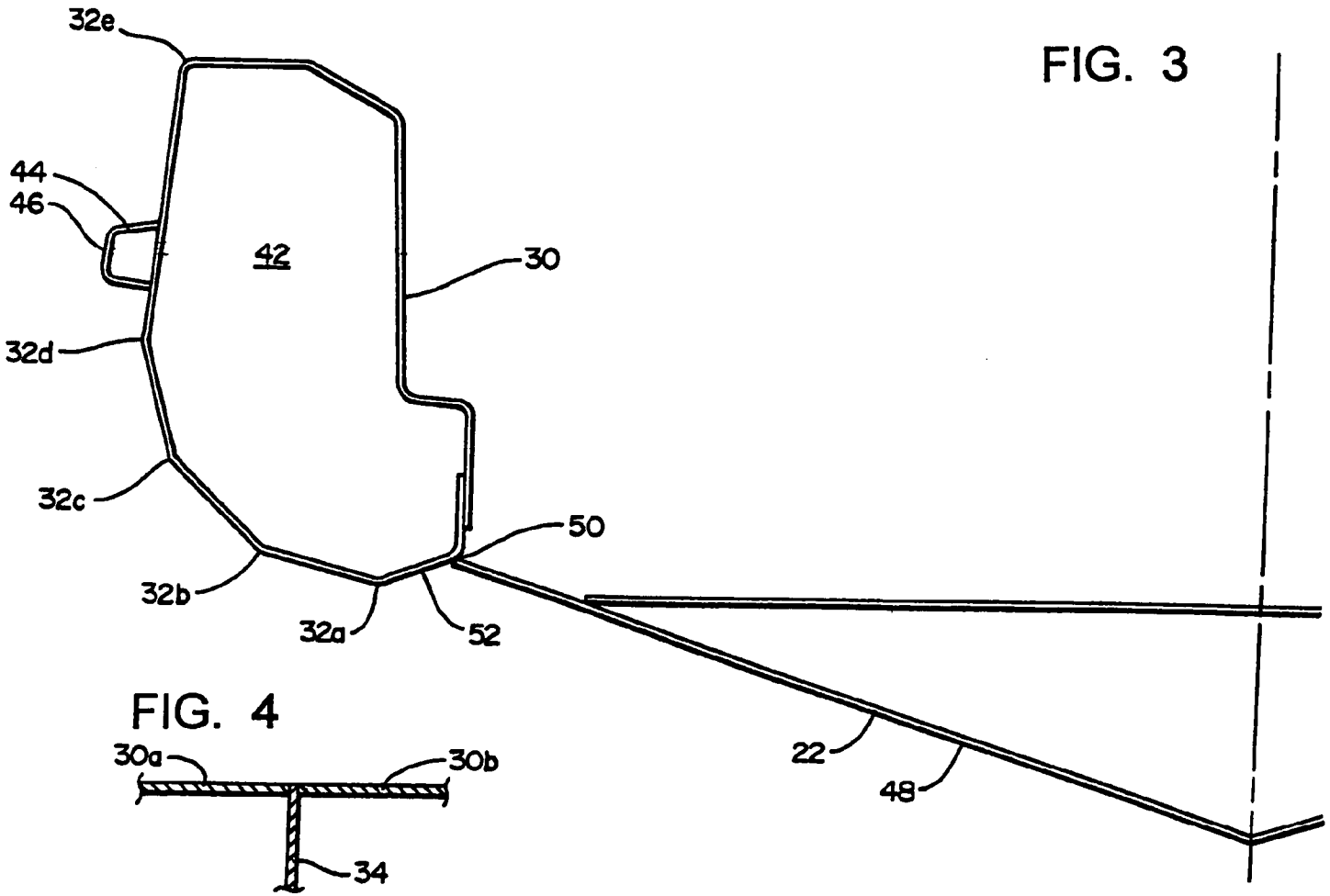
FIG. 3 is a cross sectional view of a the hull side section taken at line 3—3 in FIG. 1.
FIG. 4 is a cross sectional view of a baffle taken at line 4—4 in FIG. 1.

Between each multi-creased wall section 30, there is a baffle 34, which is positioned at the locations indicated at 36, 38 and 40. As seen in FIG. 4, the baffle 34 is connected to multi-creased walls 30*a* and 30*b*. Each pair of proximate baffles 34 in combination with a multi-creased wall sections 30 defines a chamber 42. The chambers 42 are sealed so no water can penetrate therein. The chambers are also pressurized to a 5–16 p.s.i. The internal pressure helps maintain the shape of the multi-creased walls 30 and help prevent the walls from buckling inwardly when the chambers 42 are submerged.

Figure 2:
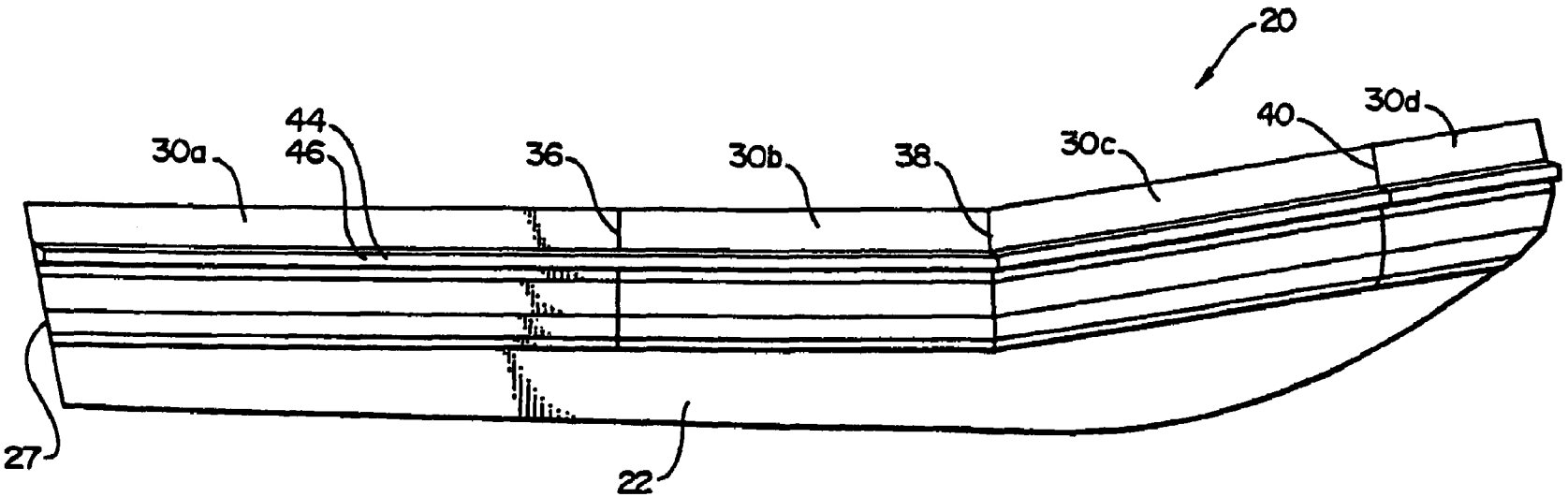
FIG. 2 is a side view of the hull configuration.

Now referring back to FIGS. 1 and 2, in the preferred embodiment the perimeter hull portion 28 comprises 7 discrete chambers. Each chamber is sealed and can provide a buoyant force of hundreds of pounds when they are submerged in water.

Along the outer edge is a multi-creased wall sections 30*a* is a perimeter rim 44 which has an outer contact surface 46 that is adapted to come in contact with obstacles such as docks and other boats before coming in contact with the multi-creased walls 30.

Figures 6, 7, 8:
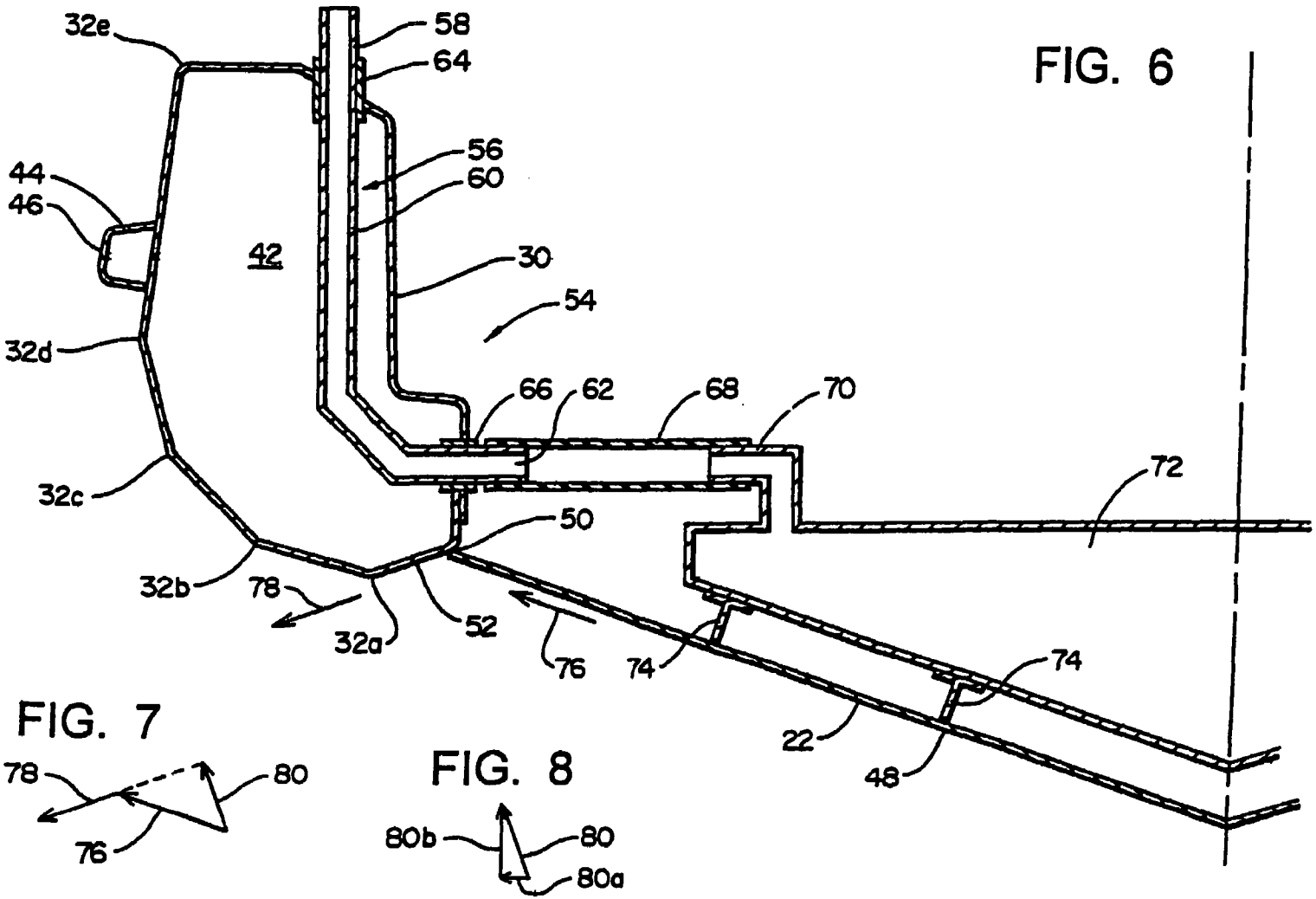
FIG. 6 is a cross sectional view of a fuel insert system taken at line 6—6 in FIG. 1.
FIG. 7 is a vector diagram of the mean fluid velocities of up skirting water.
FIG. 8 is a vector diagram of the vertical and horizontal components of the resultant velocity vector derived from FIG. 7.

The V-shaped bottom wall 22 is located in the lower central hull portion of the chamber hull 20. The V-shaped bottom wall 22 has an exterior surface 48 that is in contact with the water. The V-shaped bottom wall 22 is welded to the multi-creased wall 30 at point 50. Surface 52 is positioned between point 50 and crease 32*a*. As water flows along exterior surface 48 in an upward direction, the water will come in contact with surface 52 which directs the water in a downward direction. The momentum change of the flowing water creates a lift upon the chambered boat hull 20 that results in a smoother ride. The angle between the contact surface 52 and V-shaped bottom wall 22 is approximately 152°. Assuming the water flowing parallel to the V-shaped bottom wall, the water is redirected 38°. The V-shaped bottom wall is approximately 18° from the horizontal plane and the surface 52 is approximately 20° from the horizontal plane. The lift resulting from the flowing water is governed by the momentum equation: $F=m^* \Delta v/\Delta t$; where F=Force, m=mass and $\Delta v/\Delta t$=change of velocity with respects to time. In a fluid flow problem such as this the force exerted from changing the direction of a fluid flow is a function of the density of water ρ, times the Volumetric flow rate of the water V, times the velocity change of the water Δv; which is $F_r=\rho \circ V \circ \Delta v$. To graphically represent the forces acting upon the chambered hull 20, the vector 76 represents the velocity vector of the mean flow of water traveling up the V-shaped lower wall 22. Likewise the vector 78 represents the mean flow of water off of the surface 50. The vector 78 may be slightly shorter than vector 78 because there are slight losses in the change of direction of the water flow. FIG. 7 shows a resultant vector 80, which is derived from subtracting vector 76 from vector 78. As seen in FIG. 8, this resultant vector 80 comprises a vertical component 80*b* and a horizontal component 80*a*. The vertical component 80*b* is the net change in velocity of the water flow that can be used to calculate the vertical force exerted upon the chambered hull 20; this resultant force being $F_r= \rho \circ V \circ$(value of vertical component 80*b*). Other angles could be used for the surface 52 and V-shaped wall 22; however, the angles in the preferred embodiment are particularly advantageous for a desirable fluid flow that has an average resultant force $F_r$ that provides a substantially smoother ride.

A fuel intake system 54 is shown in FIG. 6. The internal passage 56 comprises an intake 58, a central portion 60 and an outlet 62. The intake 58 is housed around the upper sheath 64. The central portion 60 passes through the chamber 42. The outlet 62 is surrounded by lower sheath 66. The upper sheath 64 is welded to the multi-creased chamber wall 30 and the intake 58 is in tight communication to the upper sheath 64. The lower sheath 66 is welded to the multi-creased wall 30 and the outlet 62 is sealed to the lower sheath 66 which seals the chamber 42 so it can withstand a pressure differential between the inside and outside of the chamber 42.

A flexible hose 68 is connected to the outlet 62 and extends to fuel inlet 70 which is connected to fuel tank 72 which is supported above the V-shaped bottom wall 22 by tank supports 74. The location of the fuel tank 72 can be anywhere in the central portion of the hull. Using the flexible hose 68 allows the tank to be positioned in the rear of the boat because generally the fuel tank is in the stern location of the boat.

It is desirable to place the fuel intake system 54 in the central to front portion of the chambered boat hull 20. This provides convenient refueling especially when the boat is loaded in the aft portion of the chambered boat haul 20 and the fuel in the fuel tank 72 builds hydrostatic pressure in the aft portion of the fuel tank because it is positioned lower than the forward portion of the tank allowing fuel to occupy the upper aft portion of the tank 72.

Figure 9:
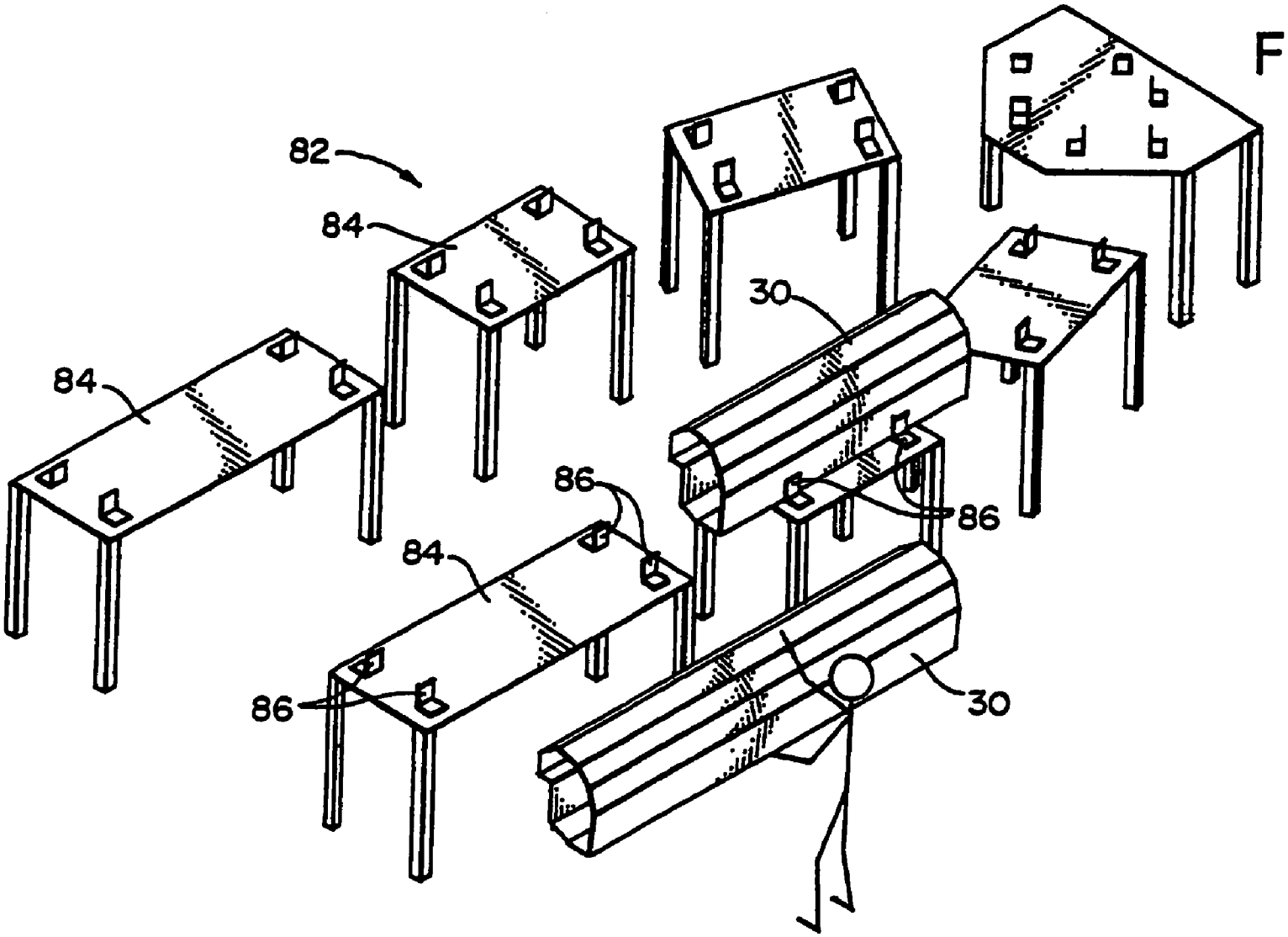
FIG. 9 is a perspective view of a method of manufacture of the aluminum chambered boat hull.

FIG. 9 shows a method of manufacturing the chambered boat hull 20. The assembly 82 comprises a plurality of stationary platforms 84. Located on each platform are placement holders 86. In a manufacturing operation the multi-creased wall sections 30 are placed on the stationary platforms 84 at a location in-between the placement holders 86. A baffle 34 is placed between each multi-creased wall sections 30. The baffle and two adjacent multi-creased wall sections 30 are welded together. This operation creates very consistent dimensions of the boats.

Thereafter the V-shaped bottom wall 22 is welded to the perimeter chamber assembly 37 (see FIG. 1) and the rest of the construction of the boat can take place thereafter.

While the invention is susceptible of various modifications and alternative forms, specific embodiments thereof have been shown by way of example in the drawings and described in detail. It should be understood, however, that it is not intended to limit the invention to the particular forms disclosed, but, on the contrary, the intention is to cover all modifications, equivalents and alternatives falling within the spirit and scope of the invention. Specific embodiments have been shown by way of example in the drawings are described in detail. Its should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. A multichambered boat hull having a central lower portion and a lateral portion comprising:

a central outer contact surface sloping upwardly in the lateral direction and has a laterally inwardly and in a laterally outward portion, a perimeter contact surface that slopes downwardly in the lateral direction and is in contact with the laterally outward portion of the central outer contact surface, whereas the central outer contact surface is adapted to direct water in a lateral and upward direction to the perimeter contact surface and the perimeter contact surface is adapted to redirect the water laterally and downwardly to provide lift upon the multichambered boat hull.

2. The multichambered boat hull as recited in claim 1 further comprising:

where the perimeter contact surface has an opposing surface that partially defines a flotation chamber.

3. The multichambered boat hull as recited in claim 2 further comprising:

the flotation chambers are located in the perimeter portion of the multichambered boat.

4. The multichambered boat hull has decided and claimed 3 further comprising:

the flotation chambers are pressurized to at least five p.s.i. to provide wall stability for the chambers.

* * * * *